US011417347B2

(12) United States Patent
Johnson et al.

(10) Patent No.: US 11,417,347 B2
(45) Date of Patent: Aug. 16, 2022

(54) BINAURAL ROOM IMPULSE RESPONSE FOR SPATIAL AUDIO REPRODUCTION

(71) Applicant: Apple Inc., Cupertino, CA (US)

(72) Inventors: Martin E. Johnson, Los Gatos, CA (US); Juha O. Merimaa, San Mateo, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/316,408

(22) Filed: May 10, 2021

(65) Prior Publication Data

US 2021/0398545 A1 Dec. 23, 2021

Related U.S. Application Data

(60) Provisional application No. 63/041,651, filed on Jun. 19, 2020.

(51) Int. Cl.

| | |
|---|---|
| ***G10L 19/008*** | (2013.01) |
| ***H04S 7/00*** | (2006.01) |
| ***H04S 3/00*** | (2006.01) |

(52) U.S. Cl.
CPC ..... *G10L 19/008* (2013.01); *H04S 3/008* (2013.01); *H04S 7/304* (2013.01); *H04S 2400/01* (2013.01); *H04S 2400/11* (2013.01); *H04S 2420/01* (2013.01)

(58) Field of Classification Search
CPC ..... G10L 19/008; H04S 3/008; H04S 7/304; H04S 2400/01; H04S 2400/11; H04S 2420/01
USPC ..... 381/17
See application file for complete search history.

(56) References Cited

U.S. PATENT DOCUMENTS

2018/0091924 A1 3/2018 Hammerschmidt
2019/0313200 A1* 10/2019 Stein ..... G06F 3/012

* cited by examiner

*Primary Examiner* — Paul Kim
(74) *Attorney, Agent, or Firm* — Womble Bond Dickinson (US) LLP

(57) ABSTRACT

A binaural room impulse response (BRIR) can be generated based on a position of a listener's head, and a plurality of head related impulse responses (HRIRs). Each of the plurality of HRIRs are selected for a respective one of a plurality of acoustic reflections which, when taken together, approximate reverberation of a room. Each of the acoustic reflections have a direction and a delay. The BRIR filter is applied to source audio to generate binaural audio output.

20 Claims, 8 Drawing Sheets

BINAURAL ROOM IMPULSE RESPONSE FOR SPATIAL AUDIO REPRODUCTION

CROSS-REFERENCE TO RELATED APPLICATION

This application claims the benefit of U.S. Provisional Patent Application No. 63/041,651 filed Jun. 19, 2020, which is incorporated by reference herein in its entirety.

FIELD

One aspect of the disclosure relates to binaural room impulse response for spatial audio reproduction.

BACKGROUND

Humans can estimate the location of a sound by analyzing the sounds at their two ears. This is known as binaural hearing and the human auditory system can estimate directions of sound using the way sound diffracts around and reflects off of our bodies and interacts with our pinna.

Audio capture devices such as microphones can sense sounds by converting changes in sound pressure to an electrical signal with an electro-acoustic transducer. The electrical signal can be digitized with an analog to digital converter (ADC). Audio can be rendered for playback with spatial filters so that the audio is perceived to have spatial qualities. The spatial filters can artificially impart spatial cues into the audio that resemble the diffractions, delays, and reflections that are naturally caused by our body geometry and pinna. The spatially filtered audio can be produced by a spatial audio reproduction system and output through headphones.

SUMMARY

A spatial audio reproduction system with headphones can track a user's head motion. Binaural filters can be selected based on the user's head position, and continually updated as the head position changes. These filters are applied to audio to maintain the illusion that sound is coming from some desired location in space. These spatial binaural filters are known as Head Related Impulse Responses (HRIRs).

The ability of a listener to estimate distance (more than just relative angle), especially in an indoor space, is related to the level of the direct part of the signal (i.e., without reflection) relative to the level of the reverberation (with reflections). This relationship is known as the Direct to Reverberant Ratio (DRR). In a listening environment, a reflection results from acoustic energy that bounces off one or more surfaces (e.g., a wall or object) before reaching a listener's ear. In a room, a single sound source can result in many reflections from different surfaces at different times.

In order to create a robust illusion of sound coming from a source in a room, the spatial filters and the binaural cues that are imparted into left and right output audio channels should include reverberation. This reverberation is shaped by the presence of the person and the nature of the room and can be described by a set of Binaural Room Impulse Responses (or BRIRs).

In some aspects of the present disclosure, a method is described that spatializes sound using BRIRs that have built-in reflection patterns. These BRIRs can be continuously updated to reflect any changes in a user's head position. A source audio stream can contain a plurality of source audio objects that have a spatial perspective. For example, the source audio stream can be object-based audio where each sound source can have associated metadata describing a location, direction, and other audio attributes.

A binaural room impulse response (BRIR) filter is generated based on a) a position of a user's head, and b) a plurality of head related impulse responses (HRIRs). Each of the HRIRs are determined fora respective one of a plurality of acoustic reflections such that, when taken together, the acoustic reflections approximate reverberation of a room. Each of the acoustic reflections can have a direction (relative to the user's head) and a delay. In some aspects, each of the acoustic reflections can have a direction (relative to the user's head), a delay, and an equalizer. The direction of a particular reflection is a direction of arrival to the user's head from a virtual location. The virtual location can be selected arbitrarily, but with controlling restraints such as restricting a reflection angle, as described in other sections. The delay that is associated with a reflection is an amount of time passed between the direct sound (or a first reflection) and a particular reflection. The equalizer simulates frequency dependent absorption of the sound by the reflecting surfaces. Controlling restraints can similarly be specified to dictate how the reflections are dispersed in the BRIR over time.

The binaural room impulse response (BRIR) filter (comprising a left BRIR filter set and a right BRIR filter set) can be applied to each of the plurality of source audio objects to produce a plurality of filtered audio objects (a left and right output signal for each object). The left and right output signals for each object are added together to produce a left audio channel and a right audio channel for audio output by a left earpiece speaker and a right earpiece speaker of a headset.

The BRIR can, in this manner, represent a plurality of reflections with different directions and delays. Each of these reflections act as 'images' of a direct sound source reflected off a virtual surface. These reflections, when taken together, resemble reverberation of a room. Because this reverberation is not physically dependent on geometry of a room, desirable characteristics of room reverberation can be imitated, while undesirable room reverberation characteristics are discarded.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, algorithms, structures, and techniques have not been shown in detail so as not to obscure the understanding of this description.

The field of architectural acoustics endeavors to make rooms "sound good". For example, concert halls are designed to provide pleasing acoustics. By producing reverberation in the right amounts and with the right characteristics, designed spaces can give the listener a pleasing acoustic experience. For small rooms, providing a pleasing acoustic experience can be a challenge. Many of the problems related to small rooms relate to their construction. They are typically built as hard-walled rectangles with large flat surfaces. Typical problems include, low frequency resonances (also known as modes), slap echoes, poor diffusion, poor absorption, low direct to reverberant ratio (DRR), and poorly spaced early reflections. Much effort and resources are put into the design and construction of these types of room to overcome these problems that the four walls create.

For example, if the application of interest is to create a spatial audio rendering of movie soundtracks (e.g., put virtual audio sources out into the room and on the screen), then it is important to choose or design the room carefully in order to allow a pleasing and enveloping experience while maintaining the illusion. In order to maintain the illusion of spatial audio, the audio needs to be somewhat congruent with the physical space in which the virtual source is rendered. For example, it is not believable if the user is located in a living room but the sounds played to the user are rendered as if the user is in a concert hall. With virtual audio, rendering of sounds are not restricted to creating reverberation from physically realizable rooms. Reverberation can be artificially created that avoids problems that are inextricably linked to small rooms while maintaining the main reverberation characteristics of a small room.

Figure 1:
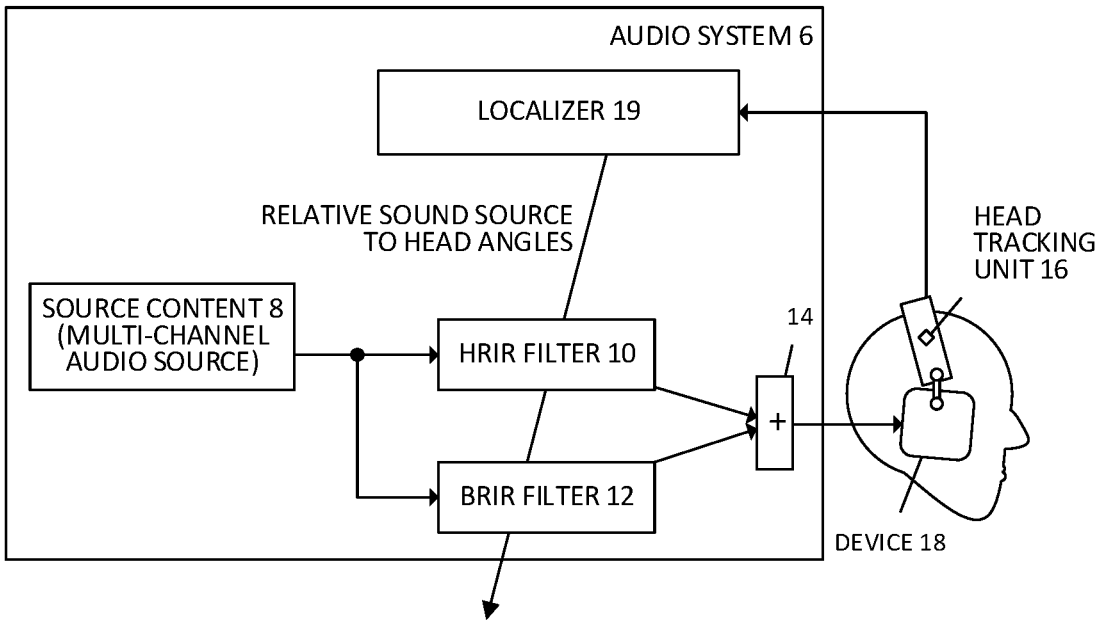
FIG. 1 illustrates a system and method for rendering spatial audio, according to some aspects.

FIG. 1 shows a system and method 6 for spatial audio reproduction with head-tracking. The system artificially generates reverberation by creating a set of acoustic reflections (or image sources) that form a reflection pattern. This reflection pattern approximates reverberation of a room and provides flexibility to avoid some of the problems linked to small rooms.

The reverberation in a room can be described by a set of acoustic reflections (or image sources), each reflection having at least a direction and a delay. In some aspects, each reflection is further associated with a level. The level for reflections can generally decrease as delay increases, although not necessarily in each and every reflection. In some aspects, each reflection is further associated with an equalizer (EQ), as further described in other sections.

A head worn device 18 can have a left earpiece speaker and a right earpiece speaker. The head-worn device can have an in-ear, on-ear, over-ear, supra aural or extra aural design.

The device can include a head tracking unit 16 that senses position of the wearer's head. The head tracking unit can include one or more sensors such as, for example, one or more an inertial measurement units (IMU), one or more cameras (e.g., RBD cameras, depth cameras, LiDAR), or combinations thereof. An IMU can include one or more accelerometers and/or gyroscopes.

A localizer 19 can process sensed data from the head tracking unit to determine a position, including a 3D direction (also known as orientation) and/or 3D location, of the user's head. The direction of the user's head can be described in spherical coordinates, such as, for example, azimuth and elevation, or other known or equivalent terminology. Location can be described by coordinates (e.g., x, y, and z) in a three-dimensional coordinate system.

For example, images from a camera of the head tracking unit can be processed with simultaneous localization and mapping (SLAM) or equivalent image processing technology to determine the position of the user's head. Similarly, inertial-aided localization algorithms can process IMU data (including acceleration and/or rotational velocity) to localize the wearer's head. A relative source to head angle is determined, based on the localization. The 'source' here can be a direct source or a reflection of the source.

A binaural room impulse response (BRIR) filter 12, can be generated based on a) the localized position of the user's head, and b) a plurality of head related impulse responses 10 (HRIRs). Each of the HRIRs are determined fora respective one of a plurality of acoustic reflections, where each of the plurality of acoustic reflections has a direction, and a delay.

In other words, HRIRs can be selected (from a library of pre-determined HRIRs) for each and every reflection of a reflection pattern, based on the direction of a corresponding reflection relative to the user's head. The overall room impulse response (e.g., BRIR filter 12) is generated by adding together all the selected HRIRs.

In such a manner, the system and method creates reverberation that controls the reflection parameters while maintaining the basic characteristics of a small room. Once a room with reflections has been created, then a person (or equivalently their head-related impulse responses) can be used to generate binaural room impulse responses at the ears (BRIRs) fora set of head orientations in the room. BRIRs are measurements that capture the spectral filtering properties of the head and ears, and can include room reverberation. Measurements are typically made in reverberant rooms using dummy heads that are rotated above their torso to capture multiple head orientations for a number of source locations within the room.

Head-related impulse responses (HRIRs) in the time domain, or head-related transfer functions (HRTFs) in the frequency domain, characterize the spectral filtering between a sound source and the eardrums of a subject. They are different for each ear, angle of incidence, and can vary from person to person due to the anatomical differences. Libraries of pre-determined HRIRs are available for different angles and different anatomy.

The HRIR filter 10 can include a set of filters for the left ear and set of filter for the right ear. The HRIR filter imparts spatial cues (e.g., delays and gains for different frequency bands) into audio at different frequencies, when applied through convolution. These spatial cues are specific and unique to a particular direction. For example, human pinna will treat sounds coming from the floor and ceiling differently. The human auditory system recognizes this difference and, from the specific cues in the audio, glean a direction from which the sound is emanating from.

For example, if a user turns her head, assuming the sound source remains in the same virtual location, then the relative sound source to head angle also changes. Accordingly, the HRIR changes (is re-selected) so that new spatial cues are applied to the sound, thereby maintaining the illusion of the sound source at the same virtual location. The HRIR filter 10 can be continuously updated, for example, when the user changes head position and/or periodically. As a result, the BRIR filter 12 is updated to reflect the user's new head position.

Figure 2A:
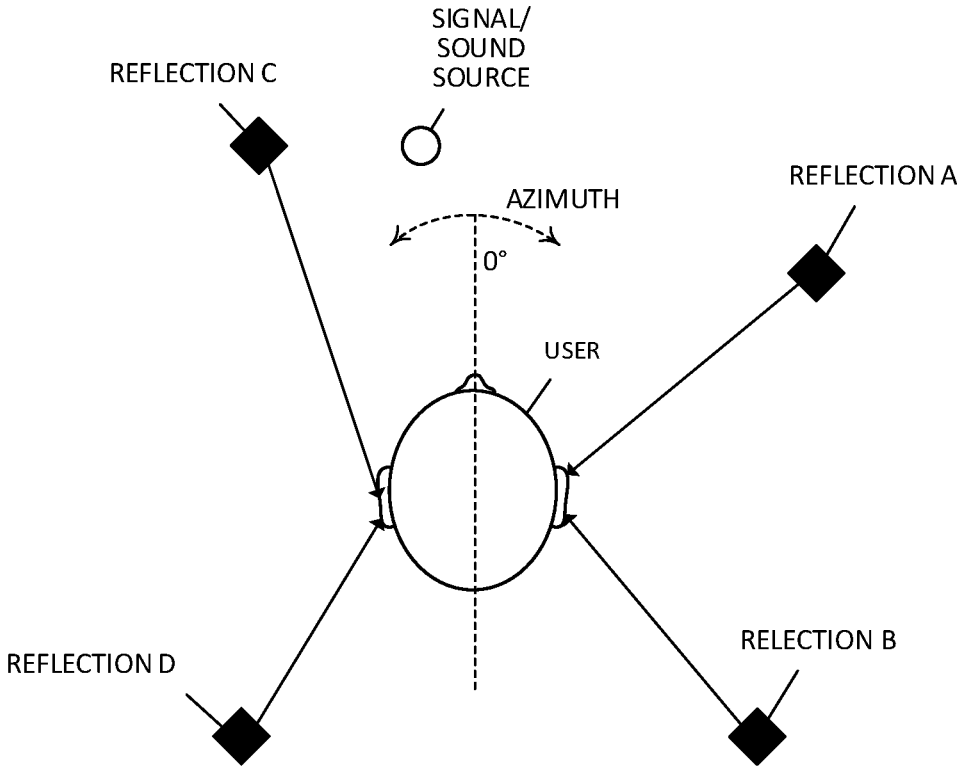
FIGS. 2A and 2B show an example of a sound source and reflection, according to some aspects.
Figure 2B:
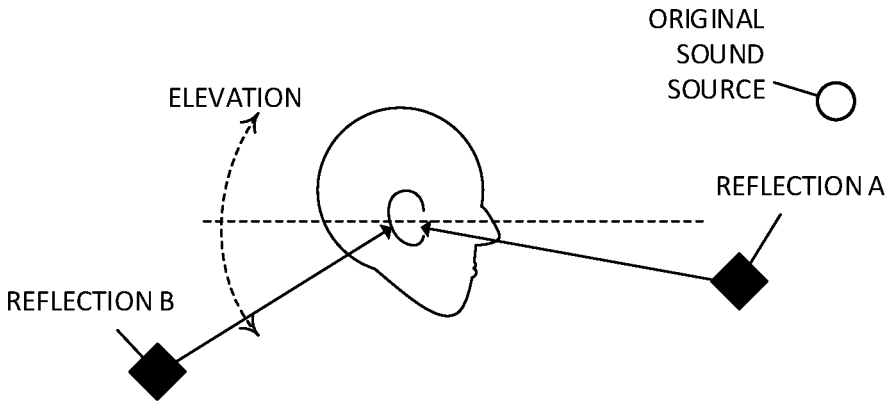

For example, referring to FIG. 2A and FIG. 2B, each of the reflections A-D has a direction from its virtual location to the user. Each reflection represents an image of the direct sound source. The direction of arrival of a reflection can be described in spherical coordinates (e.g., an azimuth and elevation) with the user's head being the origin of the coordinate system. Each reflection then has an impact on both the left and right BRIR filters as the left and the right HRIRs for that given direction of arrival contribute to the left and right BRIRs respectively. Therefore, an appropriate HRIR is selected to impart spatial cues that are specific to azimuth angle 'X' and elevation 'Y' for each reflection. Thus, the HRIR can be selected based on the direction of the acoustic reflection relative to the orientation of the user's head. It should be understood that direction can be expressed through different terminology or coordinate systems without departing from the scope of the present disclosure.

The 'delay' associated with each reflection defines a time from the direct sound (or a first reflection) that the HRIR becomes active in the BRIR, given that the BRIR is comprised of a plurality of selected HRIRs. For example, reflection A can have a delay of 1.1 ms and reflection B can have delay of 2.9 ms. In this case, an HRIR would be selected in the direction associated with reflection A, active at a delay of 1.1 ms. Another HRIR would be selected in the direction associated with reflection B, this HRIR being active at a delay of 2.9 ms. If the user turns her head to the right by 5 degrees, different HRIRs for each reflection can be selected, to account for the new direction of those same reflections to the user's ears. As a result, the reflections and reverberation effect caused by the reflections are updated with respect to the user's head position.

Referring back to FIG. 1, the BRIR filter 12, that has been generated by combining the selected HRIRs, is applied to each of the plurality of source audio objects (e.g., through convolution) to produce a plurality of filtered audio objects. These filtered audio objects have spatial cues.

The BRIR filter can be described as a left set of filters associated with a left channel and a right set of filters associated with a right channel. The left set of filters are applied to the source audio objects to generate filtered audio objects for spatial rendering to the left ear. Similarly, the right set of filters are applied to the source audio objects to generate filtered audio objects for spatial rendering to the right ear. The filtered audio objects are combined at block 14 by adding up the signals for each ear to produce a single left audio channel and a single right audio channel, which are used for audio output by a left earpiece speaker and a right earpiece speaker of a headset (e.g., device 18).

Source content 8 can be object-based audio where each sound source is an audio signal having metadata describing a location and/or direction of the sound source. Source content 8 can also be a multi-channel speaker output format. In this case, each channel can be associated with a speaker location (e.g., front, center, left, right, back, etc.) relative to a user or an arbitrary point in a listener location, thus providing a spatial perspective. Examples of multi-channel formats include 5.1, 7.1, Dolby Atmos, DTS:X, and others.

The audio system 6, which performs the localization and filtering, can be an electronic device such as, for example, a desktop computer, a tablet computer, a smart phone, a computer laptop, a smart speaker, a media player, a headphone, a head mounted display (HMD), smart glasses, or an electronic device for presenting AR or MR. Although shown separate, audio system 6 can be integrated as part of device 18.

Figure 3:
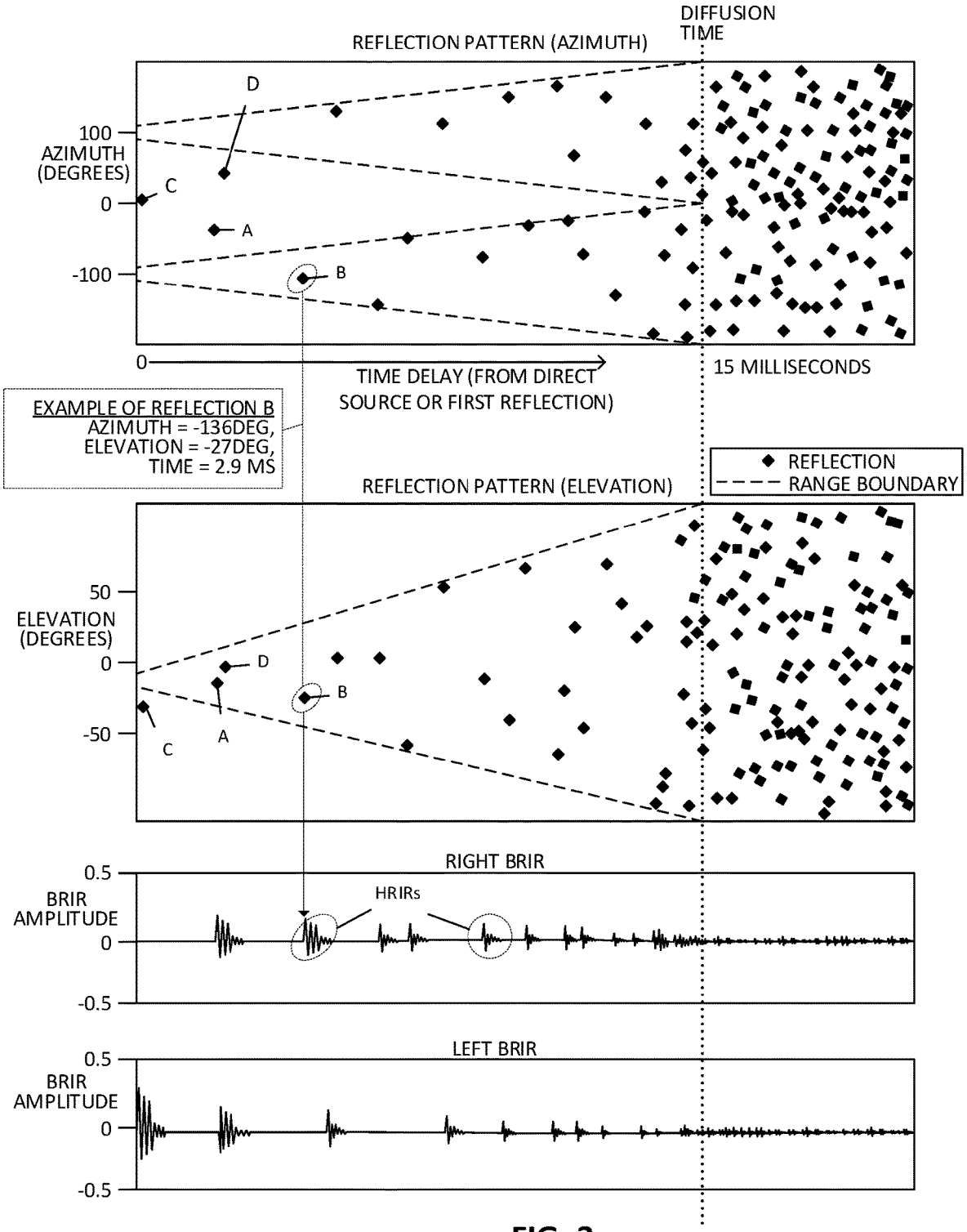
FIG. 3 illustrates an example designed reflection pattern, according to some aspects.

FIG. 3 illustrates a reflection pattern defined in spherical coordinates, and BRIRs generated from HRIRs. The reflection pattern is used to select HRIRs to be active at different times (e.g., through respective delays of each reflection). These selected HRIRs are combined to form the left and right BRIRs. These BRIRs form the BRIR filter that is applied to source audio as described in relation to FIG. 1.

The distribution of reflections in the reflection pattern can be defined in a controlled manner to yield a reflection pattern that produces a desired reverberation effect. For illustration purposes, reflections A-D can be mapped from FIG. 3 to FIG. 2 to show an example of how a reflection pattern is assembled with different directions and different time delays.

In a typical room there are a few early well-spaced (in time and direction) large reflections. As time passes from the direct sound, the number of reflections per second increases while the magnitude (also known as level) of each reflection gets smaller. The density over time can be defined as a number of reflections over different time periods, or as a rate of change. For example, the reflection density can be described as increasing 'X' number of reflections every 'Y' milliseconds.

Further, a time can be specified where the sound field becomes diffuse. In the example shown in FIG. 3 the field is specified to become completely diffuse at 15 ms. "Diffuse" means that a reflection is as likely to come from any one point on the sphere as any other. After 15 ms, the location of each of the reflections are just as likely to come from any point on the sphere as any other.

In some aspects, a pattern of the acoustic reflections is controlled by specifying a range of reflection angles, (e.g., an azimuth range, and/or an elevation range). For example, a range of reflection angles for reflections heard by the left ear can start at azimuth 100 with a range of +−10 degrees, as shown in FIG. 3. This range can increase as delay time increases. In other words, the range of azimuth and elevation that reflections are permitted in can be specified, and this specified range can increase over time. It should be noted, however, that a special rule can be applied to the first one, two, or three reflections (in this example, reflections A, C, and D). These reflections can be outside of the specified range, depending on the intended effect of the reflections.

In some aspects, the reflection angles are limited to be substantially 'behind' the listener at an early time delay (e.g., the first 1, 3, or 5 milliseconds). Thus, the initial reflection angle can have an azimuth of greater than 60 degrees, or more preferably greater than 90 degrees. Specifying the range of reflection angles effects the perceived timbre and envelopment of the audio experience, and can be chosen and/or optimized according to application to achieve a desired goal, without having to be constrained by four walls typical of a room.

As shown in FIG. 3, an HRIR is selected for each of the reflections of the reflection pattern, based on the direction of the corresponding reflection (relative to the user's head). The HRIRs selected for reflections are combined to form BRIRs for left and right ears. As shown, as the number of reflections increase overtime, so does the number of HRIRs that are present in the BRIR. For each reflection, an HRIR is selected to populate the final BRIR. Further, as the time delay increases, the amplitude of the reflections and the HRIRs decrease.

As discussed, the HRIR selections are updated when the user moves her head. A head movement can thus result in a change to the left BRIR and the right BRIR. Updates can be performed periodically and/or whenever the user movers her head.

In some aspects, the reflection pattern can be unique for each object position, which means creating a set of BRIRs for each position of interest in a virtual space. Alternatively, different object directions can be treated as an offset in the look up of a BRIR (e.g., from among a plurality of BRIRs in a look-up table) as a function of head orientation. That is, an object at, for example, 30 degrees azimuth with a head orientation of 0 degrees azimuth could be rendered with the same BRIR as an object at 0 degrees azimuth with a head orientation of −30 degrees azimuth. The physical interpretation of the latter approach is as if the virtual room that each object is rendered is rotated differently relative to the listener. Further, this approach reduces size of the BRIR data set by 'reusing' BRIR information.

Figure 4:
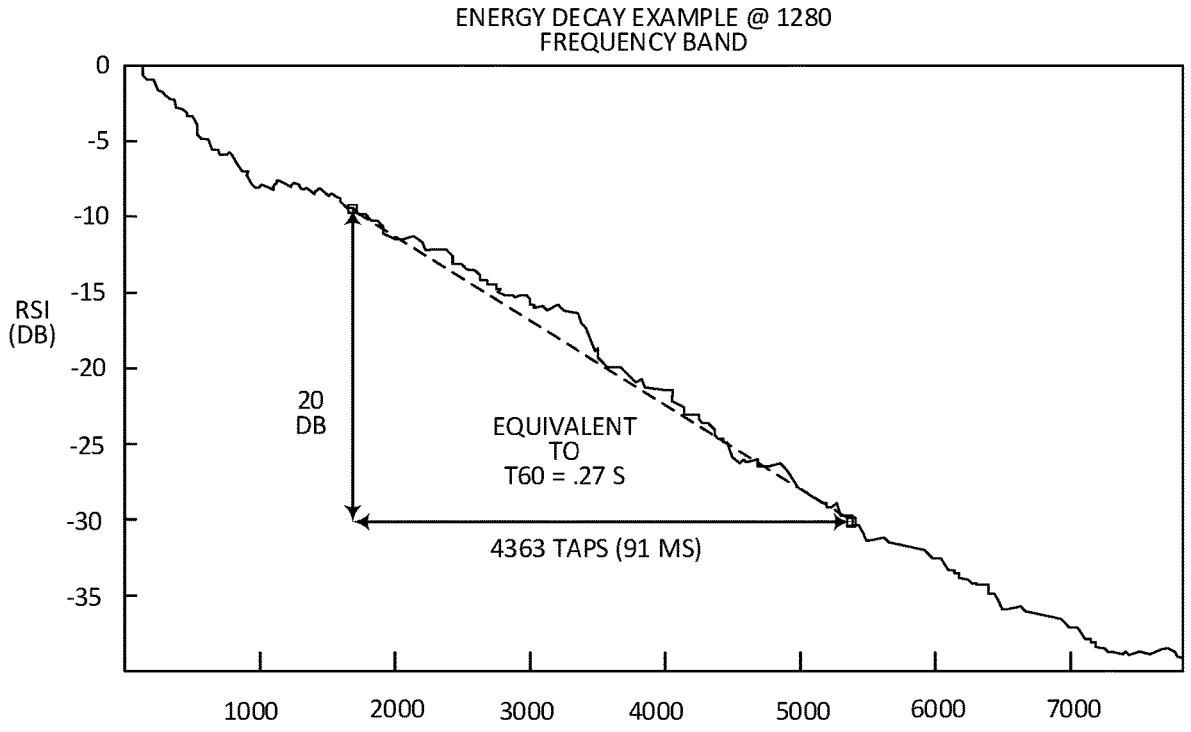
FIG. 4 illustrates an example of energy decay, according to some aspects.

FIG. 4 shows a decay curve for a typical room. EQ of reflections and management of T60 can be performed to further tailor the artificial reverberation. Typically, later reflections in a room are characterized by being attenuated due to both the distance travelled and also by having been reflected a number of times. Each time the sound is reflected off an additional surface some of the energy is lost and typically high frequencies are attenuated more than low frequencies.

The rate of absorption of energy in a given frequency band determines the T60 of a room. T60 is the time taken for energy to decay by 60 dB. For example, a room with walls draped in cloth can have higher rate of absorption (and thus, a shorter T60) than a room with bare reflective walls. An EQ filter can be defined for each reflection, to control the rate of absorption in the virtual room. In some aspects, the EQ includes a gain that is inversely proportional to decay time. For example, decay time T60 can be accurately controlled by applying an EQ filter to each reflection (at time t) by a gain given by g=60*t/T60(dB). T60 assumes a constant rate of decay (dB per sec) but, in some aspects, the profile of the decay rate can be arbitrarily defined, as desired.

Referring back to FIG. 1, the BRIR filter 12 can be described as belonging to a set of BRIRs, each associated with a different position of the user's head. As discussed, for each direction that the user turns her head, a different BRIR filter is formed from HRIRs that are unique to the direction of a particular reflection to the user's head. Abrupt differences across the different BRIRs and across different frequency bands might detract from the audio experience. An EQ filter (e.g., a global EQ filter) can be applied to each of the set of BRIRs (across the different head positions), the EQ filter being determined based on an average of the set of BRIRs. This maintains a smooth overall spectrum of the audio reverberation. Since the orientation of the head relative to the source and room can be changed as the user moves their head, the same EQ is applied across the family of BRIRs, not just to a single BRIR. To address the different BRIRs, the average level on all of the BRIRs can be used to calculate a global spectrum that is then equalized to a target response.

Figure 5:
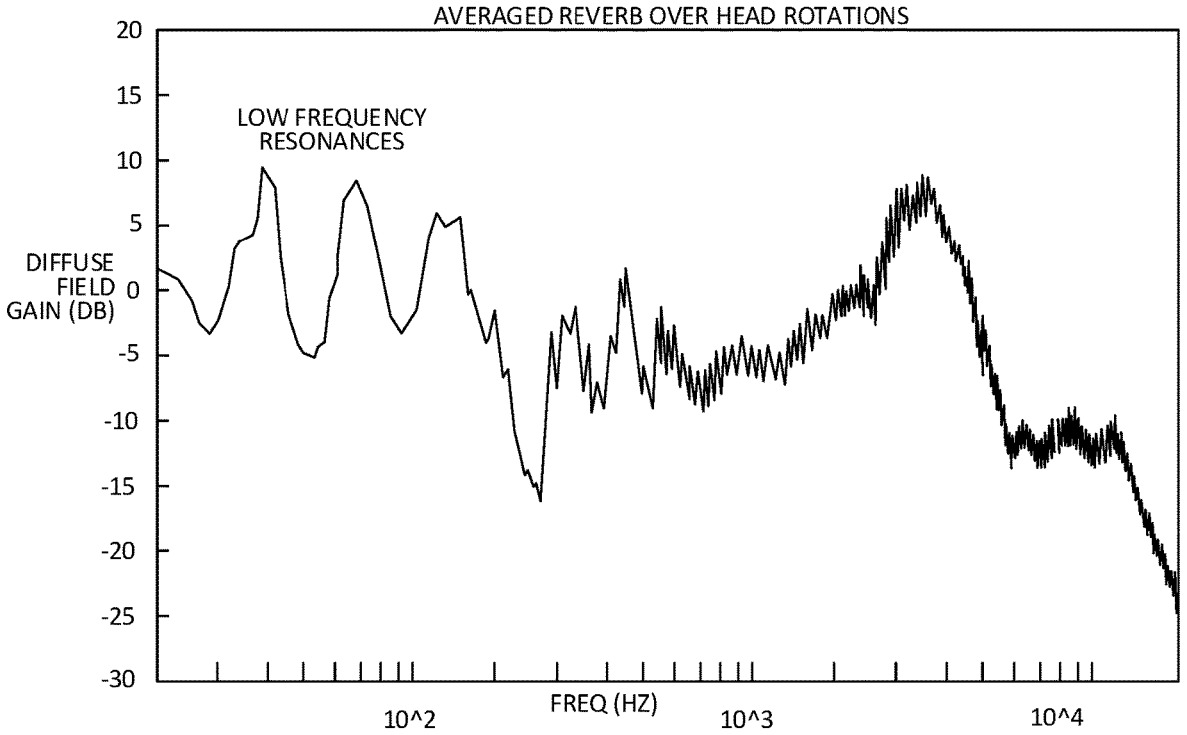
FIG. 5 shows an example of reverberation averaged over head rotations, according to some aspects.
Figure 6:
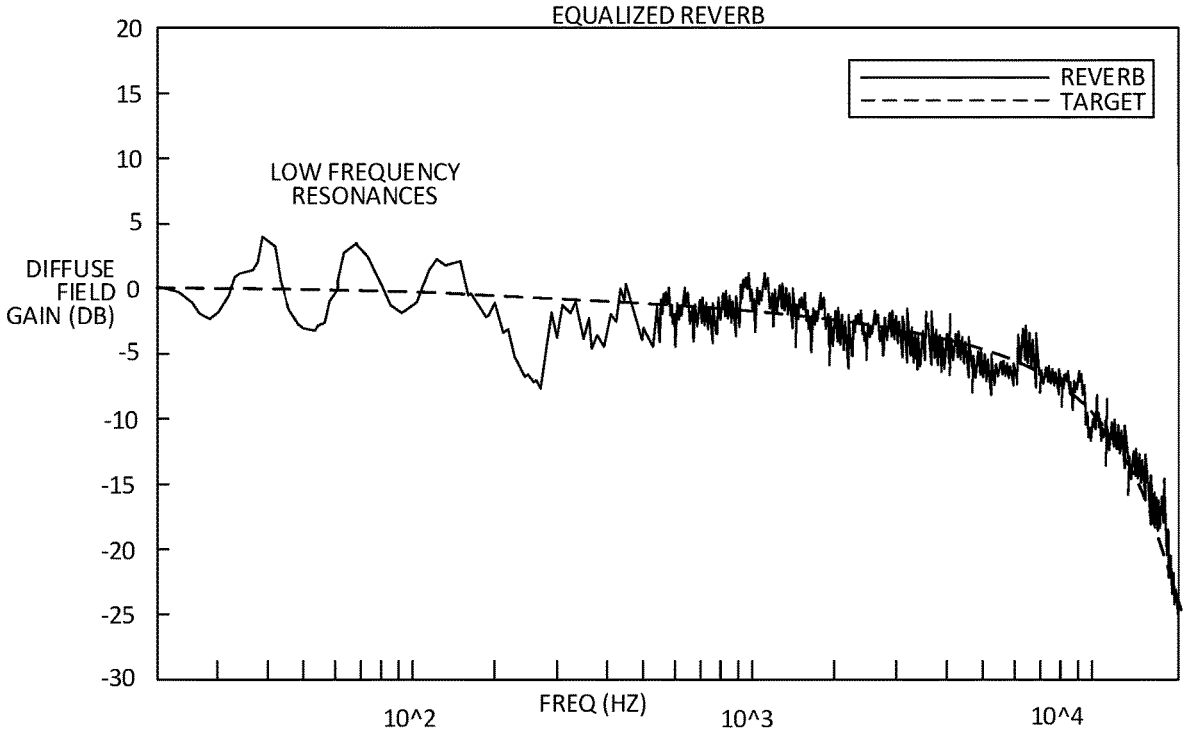
FIG. 6 shows an example of equalized reverberation, according to some aspects.

An example of the global equalization is demonstrated in FIG. 5 and FIG. 6. FIG. 5 shows an averaged reverberation overall head rotations at different frequencies. A global EQ filter and parameters thereof are determined such that, when applied to this average reverberation, the result matches a target response, as shown in FIG. 6. In other words, the global EQ filter is determined by calculating parameters (e.g., gains at different frequencies) such that the averaged reverberation meets a target response.

In some aspects, reverberation at low frequencies can be replaced or removed. A major problem with small rooms is that the first few modes of the room are typically resonant in the 30-150 Hz range e.g., the bass region. This causes large variations in level as a function of frequency and position in the room. In real rooms this problem is very difficult to solve—adding low frequency absorption typically consumes a lot of space. At higher frequencies the number of modes becomes much larger and the spatial and frequency variations become smaller due to an averaging effect.

Another related problem with a real room is that, as a user changes their distance to a source the way in which the direct field combines with the reverberant field can cause notches (in the frequency domain) to shift causing the quality and EQ of the sound to change as a function of source distance.

Figure 7:
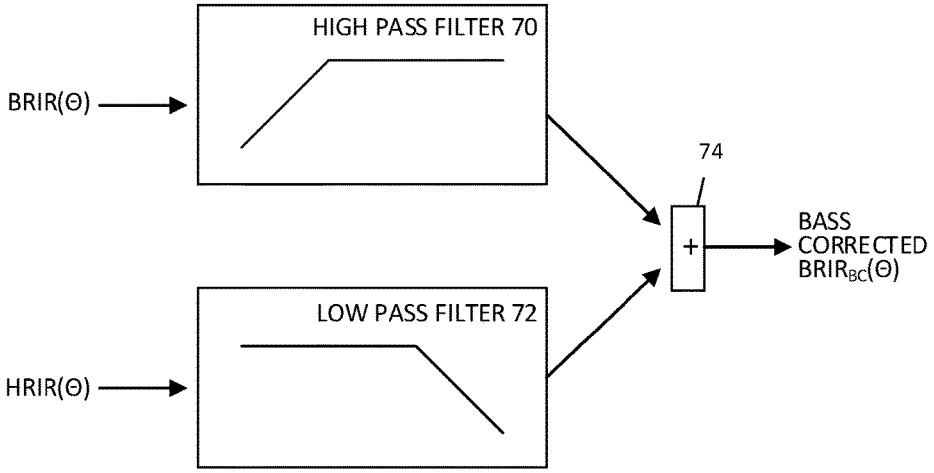
FIG. 7 shows a system for producing bass-corrected BRIR, according to some aspects.

In some aspects, the low frequency part of the reverb (or the BRIR filter) can be replaced by a single reflection or source co-incident with the original source. The bass portion of a BRIR can be replaced with a direct HRIR for a particular angle, to create a bass corrected BRIR. For example, in FIG. 7, the bass of a BRIR(θ) is replaced with the direct (HRIR(θ)) for that angle θ to create a bass corrected $BRIR_{bc}(\theta)$. High pass filter 70 can be used to remove the bass portion of the BRIR. Non-bass frequencies can be filtered out of the HRIR by low pass filter 72. The resulting BRIR and HRIR can be combined at block 74 to generate a bass corrected $BRIR_{bc}(\theta)$. Large variation in EQ at low frequencies are reduced or removed, because the HRIR is smooth at low frequencies. Further, the HRIR and the BRIR always sum coherently at low frequencies without generating notches in the frequency domain.

Figure 8:
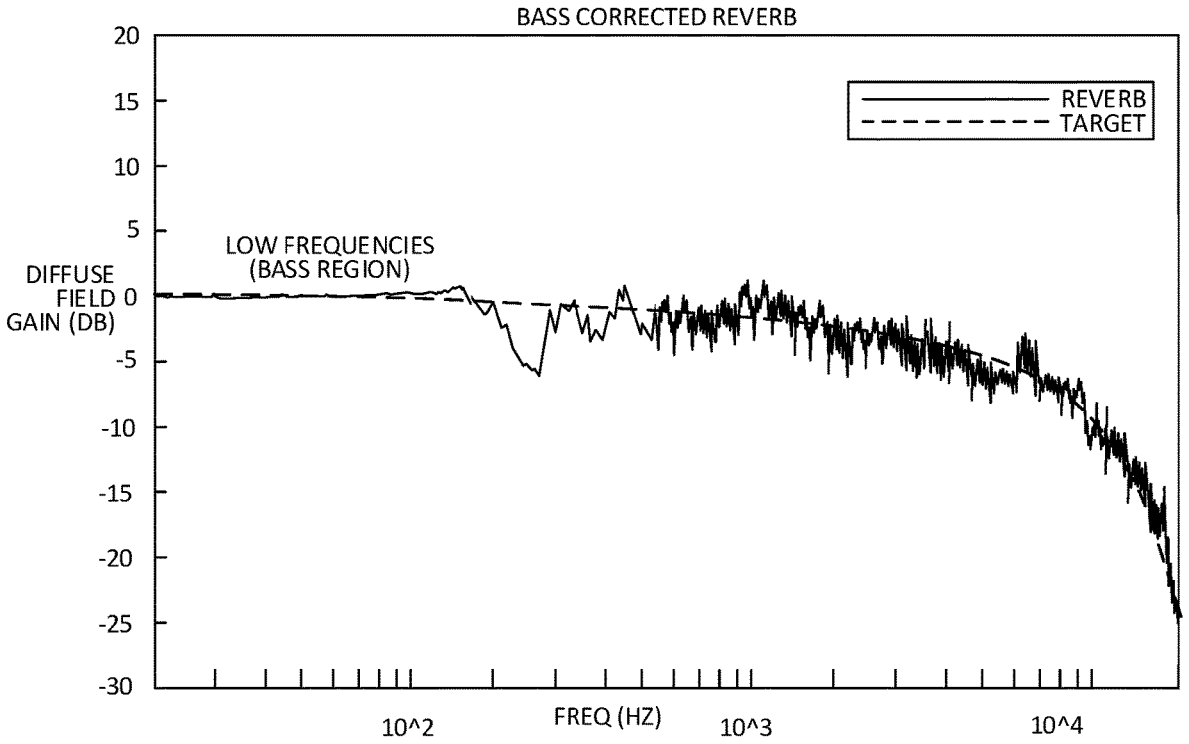
FIG. 8 shows an example of bass-corrected reverberation, according to some aspects.

FIG. 8 shows an example of the spectrum of reverberation after the bass has been replaced. In comparison with the reverberation profiles in FIG. 5 and FIG. 6, large variations at low frequencies (e.g., 30 to 150 Hz) are reduced (in FIG. 8). This brings the reverberation closer to a target reverberation. The target reverberation profile can be selected arbitrarily and vary from one application to another.

Figure 9:
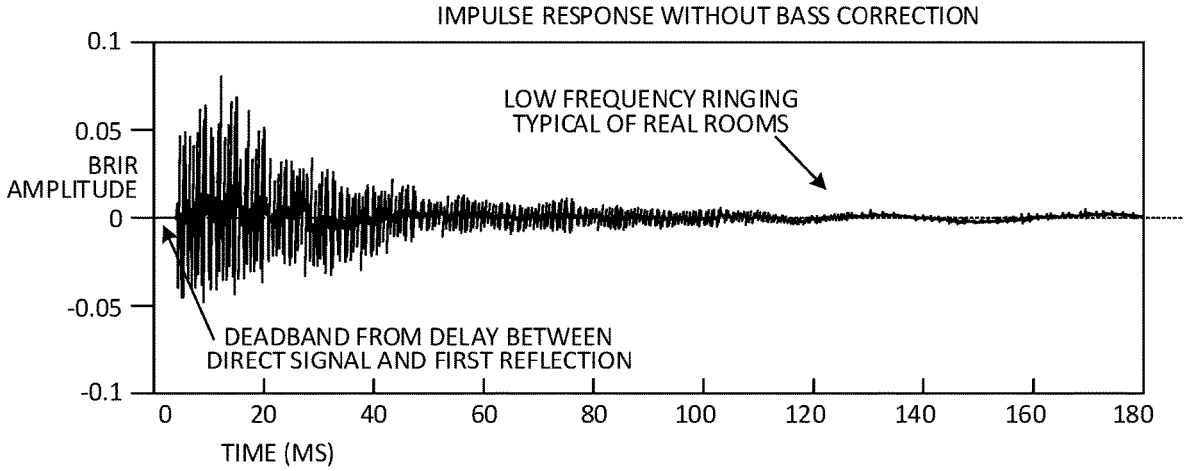
FIG. 9 and FIG. 10 show examples of impulse response, according to some aspects.
Figure 10:
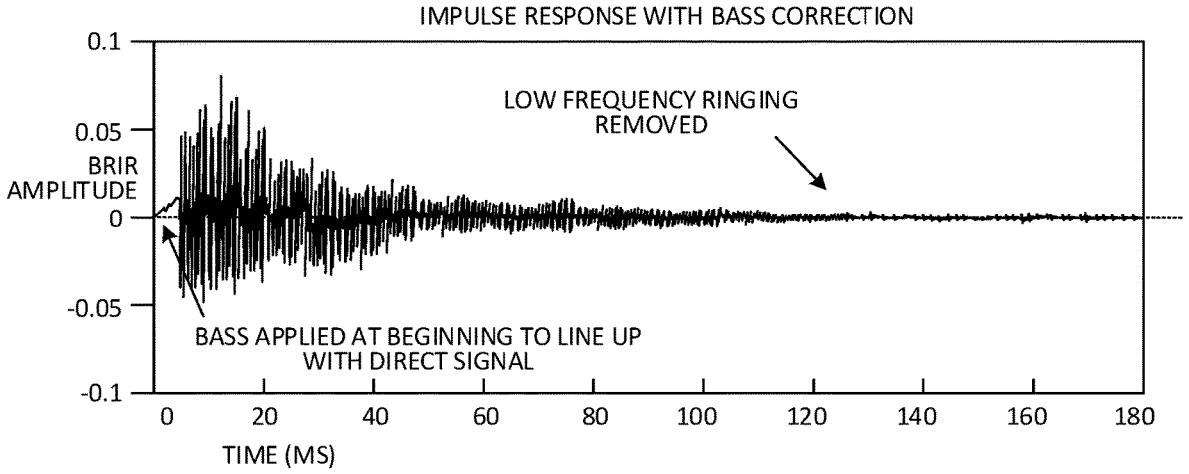

Similarly, FIG. 9 and FIG. 10 show the effect of bass correction in a BRIR in the time domain. FIG. 9 shows a BRIR without bass correction. The BRIR has a dead band at the delay between the direct signal and the first reflection. Further, there is low frequency ringing typical of real rooms. FIG. 10, on the other hand, shows a BRIR with bass correction. Bass is applied at the beginning to line up with the direct signal. Further, low frequency ringing, which can provide a negative listening experience, is removed.

Figure 11:
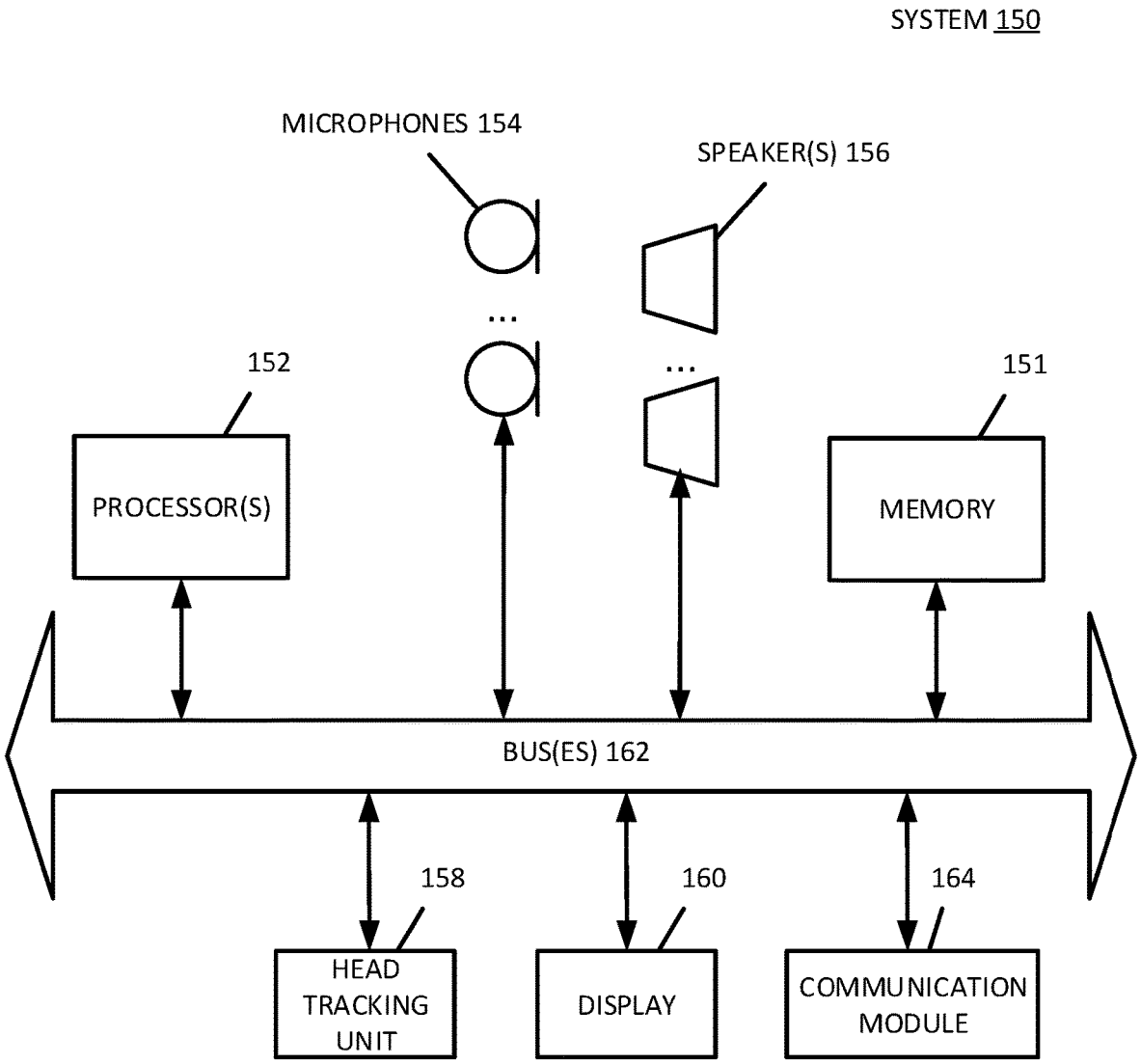
FIG. 11 shows an example audio processing system, according to some embodiments.

FIG. 11 shows a block diagram of audio processing system hardware, in one aspect, which may be used with any of the aspects described. This audio processing system can represent a general purpose computer system or a special purpose computer system. Note that while FIG. 11 illustrates the various components of an audio processing system that may be incorporated into headphones, speaker systems, microphone arrays and entertainment systems, it is merely one example of a particular implementation and is merely to illustrate the types of components that may be present in the audio processing system. FIG. 11 is not intended to represent any particular architecture or manner of interconnecting the components as such details are not germane to the aspects herein. It will also be appreciated that other types of audio processing systems that have fewer or more components than shown can also be used. Accordingly, the processes described herein are not limited to use with the hardware and software shown.

The audio processing system 150 (for example, a laptop computer, a desktop computer, a mobile phone, a smart phone, a tablet computer, a smart speaker, a head mounted display (HMD), a headphone set, or an infotainment system for an automobile or other vehicle) includes one or more buses 162 that serve to interconnect the various components of the system. One or more processors 152 are coupled to bus 162 as is known in the art. The processor(s) may be microprocessors or special purpose processors, system on chip (SOC), a central processing unit, a graphics processing unit, a processor created through an Application Specific Integrated Circuit (ASIC), or combinations thereof. Memory 151 can include Read Only Memory (ROM), volatile memory, and non-volatile memory, or combinations thereof, coupled to the bus using techniques known in the art. A head tracking unit 158 can include an IMU and/or camera (e.g., RGB camera, RGBD camera, depth camera, etc.). The audio processing system can further include a display 160 (e.g., an HMD, or touchscreen display).

Memory 151 can be connected to the bus and can include DRAM, a hard disk drive or a flash memory or a magnetic optical drive or magnetic memory or an optical drive or other types of memory systems that maintain data even after power is removed from the system. In one aspect, the processor 152 retrieves computer program instructions stored in a machine readable storage medium (memory) and executes those instructions to perform operations described herein.

Audio hardware, although not shown, can be coupled to the one or more buses 162 in order to receive audio signals to be processed and output by speakers 156. Audio hardware can include digital to analog and/or analog to digital converters. Audio hardware can also include audio amplifiers and filters. The audio hardware can also interface with microphones 154 (e.g., microphone arrays) to receive audio signals (whether analog or digital), digitize them if necessary, and communicate the signals to the bus 162.

Communication module 164 can communicate with remote devices and networks. For example, communication module 164 can communicate over known technologies such as Wi-Fi, 3G, 4G, 5G, Bluetooth, ZigBee, or other equivalent technologies. The communication module can include wired or wireless transmitters and receivers that can communicate (e.g., receive and transmit data) with networked devices such as servers (e.g., the cloud) and/or other devices such as remote speakers and remote microphones.

It will be appreciated that the aspects disclosed herein can utilize memory that is remote from the system, such as a network storage device which is coupled to the audio processing system through a network interface such as a modem or Ethernet interface. The buses 162 can be connected to each other through various bridges, controllers and/or adapters as is well known in the art. In one aspect, one or more network device(s) can be coupled to the bus 162. The network device(s) can be wired network devices (e.g., Ethernet) or wireless network devices (e.g., WI-FI, Bluetooth). In some aspects, various aspects described (e.g., simulation, analysis, estimation, modeling, object detection, etc.) can be performed by a networked server in communication with the capture device.

Various aspects described herein may be embodied, at least in part, in software. That is, the techniques may be carried out in an audio processing system in response to its processor executing a sequence of instructions contained in a storage medium, such as a non-transitory machine-readable storage medium (e.g. DRAM or flash memory). In various aspects, hardwired circuitry may be used in combination with software instructions to implement the techniques described herein. Thus the techniques are not limited to any specific combination of hardware circuitry and software, or to any particular source for the instructions executed by the audio processing system.

In the description, certain terminology is used to describe features of various aspects. For example, in certain situations, the terms "module", "processor", "unit", "renderer", "system", "device", "filter", "localizer", and "component," are representative of hardware and/or software configured to perform one or more processes or functions. For instance, examples of "hardware" include, but are not limited or restricted to an integrated circuit such as a processor (e.g., a digital signal processor, microprocessor, application specific integrated circuit, a micro-controller, etc.). Thus, different combinations of hardware and/or software can be implemented to perform the processes or functions described by the above terms, as understood by one skilled in the art. Of course, the hardware may be alternatively implemented as a finite state machine or even combinatorial logic. An example of "software" includes executable code in the form of an application, an applet, a routine or even a series of instructions. As mentioned above, the software may be stored in any type of machine-readable medium.

Some portions of the preceding detailed descriptions have been presented in terms of algorithms and symbolic representations of operations on data bits within a computer memory. These algorithmic descriptions and representations are the ways used by those skilled in the audio processing arts to most effectively convey the substance of their work to others skilled in the art. An algorithm is here, and generally, conceived to be a self-consistent sequence of operations leading to a desired result. The operations are those requiring physical manipulations of physical quantities. It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of an audio processing system, or similar electronic device, that manipulates and transforms data represented as physical (electronic) quantities within the system's registers and memories into other data similarly represented as physical quantities within the system memories or registers or other such information storage, transmission or display devices.

The processes and blocks described herein are not limited to the specific examples described and are not limited to the specific orders used as examples herein. Rather, any of the processing blocks may be re-ordered, combined or removed, performed in parallel or in serial, as necessary, to achieve the results set forth above. The processing blocks associated with implementing the audio processing system may be performed by one or more programmable processors executing one or more computer programs stored on a non-transitory computer readable storage medium to perform the functions of the system. All or part of the audio processing system may be implemented as, special purpose logic circuitry (e.g., an FPGA (field-programmable gate array) and/or an ASIC (application-specific integrated circuit)). All or part of the audio system may be implemented using electronic hardware circuitry that include electronic devices such as, for example, at least one of a processor, a memory, a programmable logic device or a logic gate. Further, processes can be implemented in any combination hardware devices and software components.

While certain aspects have been described and shown in the accompanying drawings, it is to be understood that such aspects are merely illustrative of and not restrictive on the broad invention, and the invention is not limited to the specific constructions and arrangements shown and described, since various other modifications may occur to those of ordinary skill in the art.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. A method for spatial audio reproduction, the method comprising:

obtaining a source audio stream that contains a plurality of source audio objects that have a spatial perspective;

generating a binaural room impulse response (BRIR) filter including combining a plurality of head related impulse responses (HRIRs) that are selected in view of an orientation of a user's head, each of the HRIRs being determined for a respective one of a plurality of acoustic reflections each having a direction and delay; and applying the binaural room impulse response (BRIR) filter to each of the plurality of source audio objects to produce binaural audio output including a left channel for a left earpiece speaker and a right channel for a right earpiece speaker of a headset.

2. The method of claim 1, wherein each of the acoustic reflections further includes a level and an equalization (EQ) filter.

3. The method of claim 1, wherein applying the BRIR filter includes using a direction of one of the plurality of source audio objects as an offset in looking up of the BRIR filter as a function of head orientation.

4. The method of claim 2, wherein each of the EQ filters includes a gain that is inversely proportional to decay time.

5. The method of claim 1, wherein each of the HRIRs are selected based on the direction of each of the plurality of acoustic reflections, taken with respect to the orientation of the user's head.

6. The method of claim 1, wherein a pattern of the acoustic reflections is controlled by specifying a range of reflection angles.

7. The method of claim 1, wherein a pattern of the acoustic reflections is controlled by specifying a change in reflection density over time.

8. The method of claim 1, wherein the BRIR filter belongs to a set of BRIRs, each associated with a different position of the user's head, and a global EQ filter is applied to the set of BRIRs.

9. The method of claim 8, wherein the global EQ filter is determined based on application to a global spectrum calculated from an average of the set of BRIRs, and the application of the EQ filter to the global spectrum approximates a target response.

10. The method of claim 1, wherein a low frequency portion of the BRIR filter has a single HRIR representing a single reflection.

11. The method of claim 1, wherein a low frequency portion of the BRIR filter has a single HRIR corresponding to an angle that is co-incident with a sound source in the plurality of source audio channels.

12. A spatial audio reproduction system comprising a processor, configured to perform the following:

obtaining a source audio stream that contains a plurality of source audio objects that have a spatial perspective;

generating a binaural room impulse response (BRIR) filter including combining a plurality of head related impulse responses (HRIRs) that are selected in view of an orientation of a user's head, each of the HRIRs being determined for a respective one of a plurality of acoustic reflections each of the plurality of acoustic reflections having a direction, and a delay, wherein, when taken together, the plurality of acoustic reflections approximate reverberation of a room; and applying the binaural room impulse response (BRIR) filter to each of the plurality of source audio objects to produce binaural audio output including a left channel for a left earpiece speaker and a right channel for a right earpiece speaker of a headset.

13. The spatial audio reproduction system of claim 12, wherein the position of the user's head is obtained from a head-worn device.

14. The spatial audio reproduction system of claim 13, wherein the position of the user's head is determined based on data sensed by at least one of: an inertial measurement unit (IMU), and a camera of the head-worn device.

15. The spatial audio reproduction system of claim 14, wherein the spatial audio reproduction system is integrated within a housing of the head-worn device.

16. A non-transitory machine readable medium having stored therein instructions that, when executed by a processor, causes performance of the following:

obtaining a multi-channel audio source;

generating a binaural room impulse response (BRIR) filter including combining a plurality of head related impulse responses (HRIRs) that are selected in view of an orientation of a user's head, each of the HRIRs being determined fora respective one of a plurality of acoustic reflections each being associated with a direction, and a delay; and applying the binaural room impulse response (BRIR) filter to each channel of multi-channel audio source to produce binaural audio output including a left channel for a left earpiece speaker and a right channel fora right earpiece speaker of a headset.

17. The non-transitory machine readable medium of claim 16, wherein each of the HRIRs are selected based on the direction of each of the plurality of acoustic reflections, taken with respect to the orientation of the user's head.

18. The non-transitory machine readable medium of claim 16, wherein the BRIR filter belongs to a set of BRIRs, each associated with a different position of the user's head, and a global EQ filter is applied to the set of BRIRs, the global EQ filter being determined based on application to a global spectrum calculated from an average of the set of BRIRs, and the application of the global EQ filter to the global spectrum approximates a target response.

19. The non-transitory machine readable medium of claim 16, wherein a low frequency portion of the BRIR filter has a single HRIR representing a single reflection.

20. The non-transitory machine readable medium of claim 16, wherein a low frequency portion of the BRIR filter has a single HRIR corresponding to an angle that is co-incident with a sound source in the plurality of source audio channels.

* * * * *